US011634247B2

(12) United States Patent
Nakayama et al.

(10) Patent No.: US 11,634,247 B2
(45) Date of Patent: Apr. 25, 2023

(54) BOTTLE

(71) Applicant: YOSHINO KOGYOSHO CO., LTD., Tokyo (JP)

(72) Inventors: Tadayori Nakayama, Tokyo (JP); Takanori Suzuki, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 151 days.

(21) Appl. No.: 16/387,603

(22) Filed: Apr. 18, 2019

(65) Prior Publication Data

US 2019/0322405 A1 Oct. 24, 2019

(30) Foreign Application Priority Data

Apr. 24, 2018 (JP) ..... JP2018-082742

(51) Int. Cl.
*B65D 1/02* (2006.01)

(52) U.S. Cl.
CPC .... *B65D 1/0276* (2013.01); *B65D 2501/0027* (2013.01)

(58) Field of Classification Search
CPC ..... B65D 1/0276; B65D 1/0261; B65D 2501/0027; B65D 79/0081
USPC ..... 215/383, 371, 276
See application file for complete search history.

(56) References Cited

U.S. PATENT DOCUMENTS 9,957,077 B2 * 5/2018 Dornbach ..... B65D 1/0276
2007/0084821 A1 * 4/2007 Bysick ..... B65D 79/0084 215/373
2009/0308835 A1 * 12/2009 Boukobza ..... B65D 1/0284 215/370
2010/0163513 A1 * 7/2010 Pedmo ..... B65D 1/0276 215/370

(Continued)

FOREIGN PATENT DOCUMENTS

FR 2966130 A1 * 4/2012 ..... B65D 1/0276
FR 2966130 * 10/2015
JP H07-021511 U 4/1995

(Continued)

OTHER PUBLICATIONS

Nov. 2, 2021 Office Action issued in Japanese Patent Application No. 2018-082742.

*Primary Examiner* — Anthony D Stashick
*Assistant Examiner* — Raven Collins
(74) *Attorney, Agent, or Firm* — Oliff PLC

(57) ABSTRACT

A bottle includes a bottom portion which includes a bottom wall portion with a grounding portion located at an outer circumferential edge thereof, and a tubular heel portion extending upward from an outer circumferential edge of the grounding portion, in which the bottom wall portion includes an inner circumferential wall portion extending upward from an inner circumferential edge of the grounding portion, and a recessed wall portion extending inward in a radial direction from an upper end of the inner circumferential wall portion, a plurality of concave portions or a (Continued)

plurality of convex portions are formed on the inner circumferential wall portion over the entire circumference, and the plurality of concave portions or the plurality of convex portions are located at a portion in the inner circumferential wall portion including at least a lower end edge of the inner circumferential wall portion.

3 Claims, 4 Drawing Sheets

(56) References Cited

U.S. PATENT DOCUMENTS

| | | | |
|---|---|---|---|
| 2013/0087568 | A1 | 4/2013 | Hermel et al. |
| 2015/0259090 | A1 | 9/2015 | Dornbach |

FOREIGN PATENT DOCUMENTS

| | | | | |
|---|---|---|---|---|
| JP | 2008-100720 | A | | 5/2008 |
| JP | 2009-277308 | | * | 10/2009 |
| JP | 2011-084315 | A | | 4/2011 |
| JP | 2012-076748 | A | | 4/2012 |
| JP | 2012-513943 | A | | 6/2012 |
| JP | 2016-068997 | A | | 5/2016 |
| JP | 2016-108048 | A | | 6/2016 |
| WO | 2007/023630 | A1 | | 3/2007 |

* cited by examiner

BOTTLE

BACKGROUND OF THE INVENTION

Field of the Invention

The present invention relates to a bottle.

Priority is claimed on Japanese Patent Application No. 2018-082742, filed Apr. 24, 2018, the content of which is incorporated herein by reference.

Description of Related Art

From related art, as a bottle formed of a synthetic resin material in a cylindrical shape with a bottom, for example, as illustrated in Patent Document 1, a configuration in which a bottom portion has a bottom wall portion with a grounding portion located at an outer circumferential edge thereof and a tubular heel portion extending upward from the outer circumferential edge of the grounding portion is known. The bottom wall portion includes an inner circumferential wall portion extending upward from an inner circumferential edge of the grounding portion, and a depressed wall portion extending inward in a radial direction from an upper end of the inner circumferential wall portion.

[Patent Document 1] Japanese Unexamined Patent Application, First Publication No. 2016-68997

SUMMARY OF THE INVENTION

In the bottle of the related art, the inner circumferential wall portion may deform to collapse inward in the radial direction around the lower end edge thereof at the time of so-called heat filling in which the high-temperature contents are filled, and due to this deformation, there is a possibility that the grounding portion may deform to protrude downward. This problem manifests when reducing the weight.

Thus, an object of the present invention is to provide a bottle capable of suppressing an inner circumferential wall portion from deforming to collapse inward in a radial direction around a lower end edge thereof at the time of hot filling.

A bottle according to an aspect of the present invention is formed of a synthetic resin material in a bottomed cylindrical shape, and includes a bottom portion which includes a bottom wall portion with a grounding portion located at an outer circumferential edge thereof, and a tubular heel portion extending upward from an outer circumferential edge of the grounding portion, in which the bottom wall portion includes an inner circumferential wall portion extending upward from an inner circumferential edge of the grounding portion, and a recessed wall portion extending inward in a radial direction from an upper end of the inner circumferential wall portion, a plurality of concave portions or a plurality of convex portions are formed on the inner circumferential wall portion over the entire circumference, and the plurality of concave portions or the plurality of convex portions are located at a portion in the inner circumferential wall portion including at least a lower end edge of the inner circumferential wall portion.

In the present invention, since the plurality of concave portions or the plurality of convex portions are formed on the inner circumferential wall portion over the entire circumference, the rigidity of the inner circumferential wall portion is enhanced, and it is possible to suppress the inner circumferential wall portion from deforming at the time of heat filling. In addition, since the concave portions or the convex portions are located at a portion in the inner circumferential wall portion including at least the lower end edge of the inner circumferential wall portion, it is possible to make it difficult for the inner circumferential wall portion to deform to collapse inward in the radial direction around the lower end edge thereof, and it is possible to suppress the grounding portion from deforming to protrude downward at the time of heat filling.

The plurality of concave portions may be formed on the inner circumferential wall portion over the entire circumference, and the plurality of concave portions may be continuously formed on both the grounding portion and the inner circumferential wall portion.

In this case, since the plurality of concave portions are formed on the inner circumferential wall portion over the entire circumference, and the concave portions are continuously formed on both the grounding portion and the inner circumferential wall portion, it is possible to more reliably suppress the inner circumferential wall portion from deforming to collapse inward in the radial direction around the lower end edge thereof at the time of heat filling.

Further, since the concave portions rather than convex portions reach from the inner circumferential wall portion to the grounding portion, it is possible to ensure grounding stability.

The plurality of concave portions or the plurality of convex portions may be located below the upper end of the inner circumferential wall portion.

In this case, since the concave portions or the convex portions are located below the upper end of the inner circumferential wall portion and are formed in a limited region of the bottom wall portion without reaching the recessed wall portion of the bottom wall portion, it is possible to suppress an occurrence of variations in the thickness of the bottom wall portion at the time of blow molding and to form the grounding portion with high accuracy.

According to the present invention, it is possible to suppress the inner circumferential wall portion from deforming to collapse inward in the radial direction around the lower end edge thereof during heat filling.

DETAILED DESCRIPTION OF THE INVENTION

Hereinafter, a bottle according to an embodiment of the present invention will be described with reference to the drawings.

Figure 1:
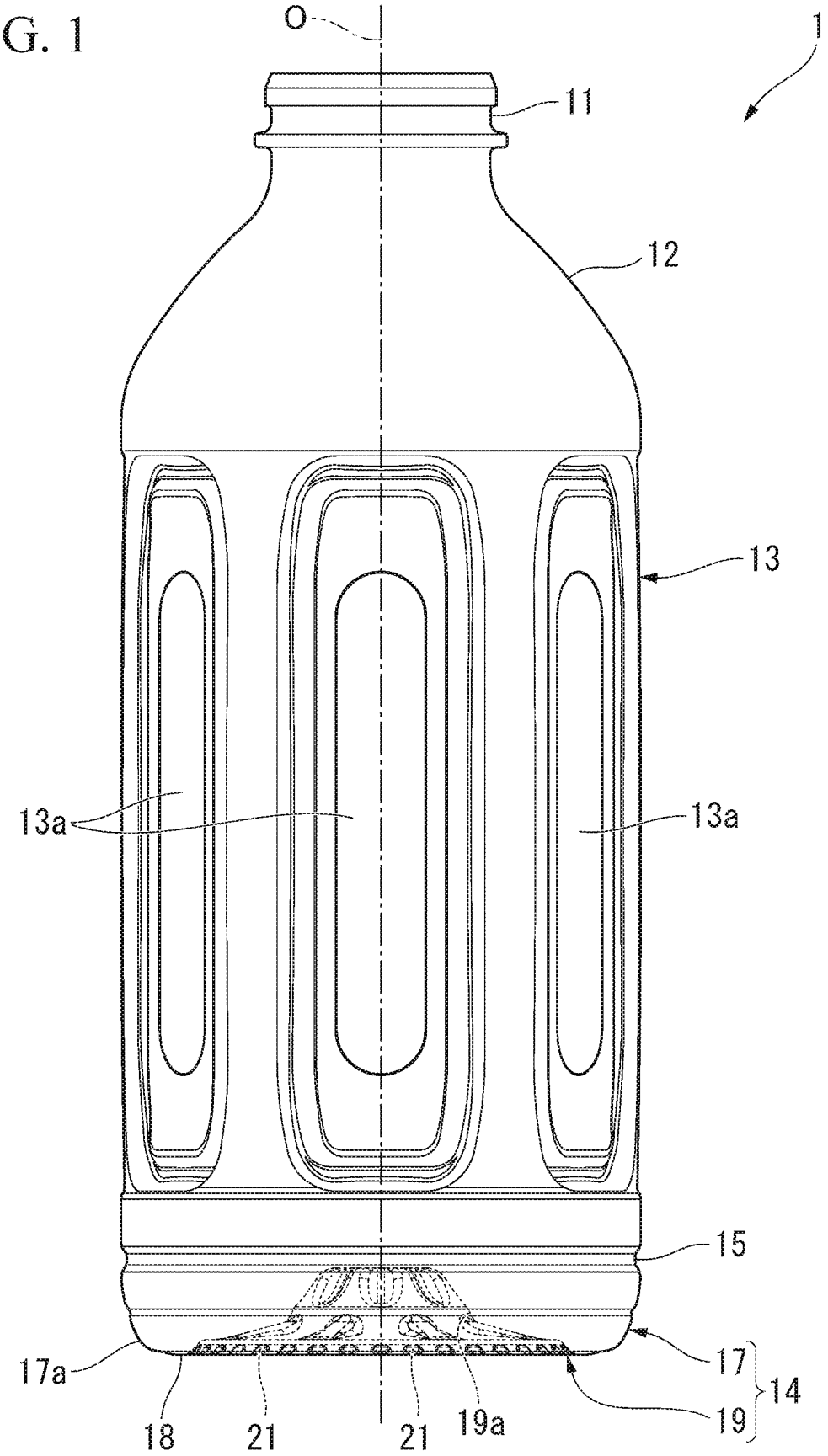
FIG. 1 is a side view of a bottle illustrated as a first embodiment according to the present invention.
Figure 2:
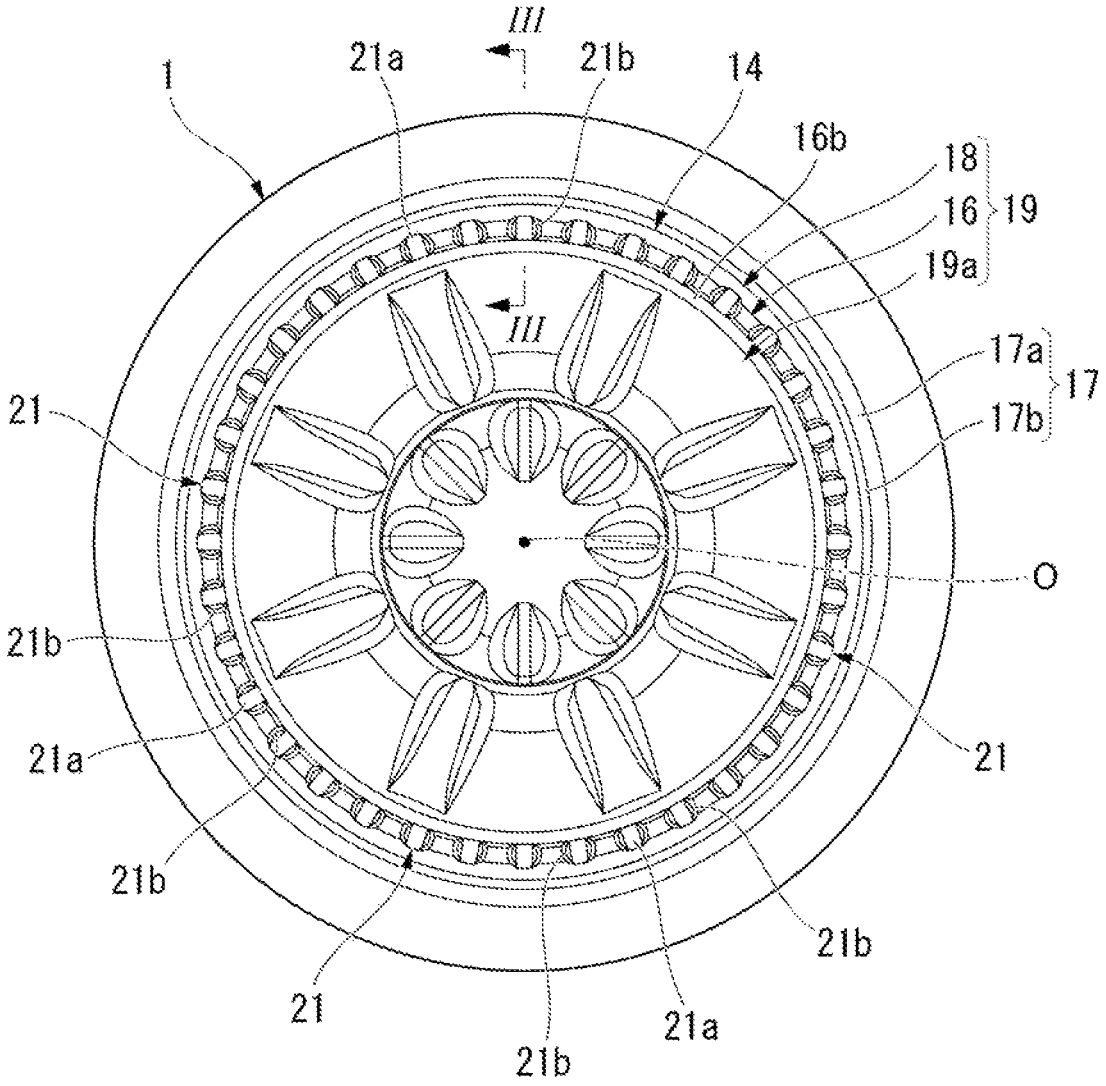
FIG. 2 is a bottom view of the bottle illustrated in FIG. 1.
Figure 3:
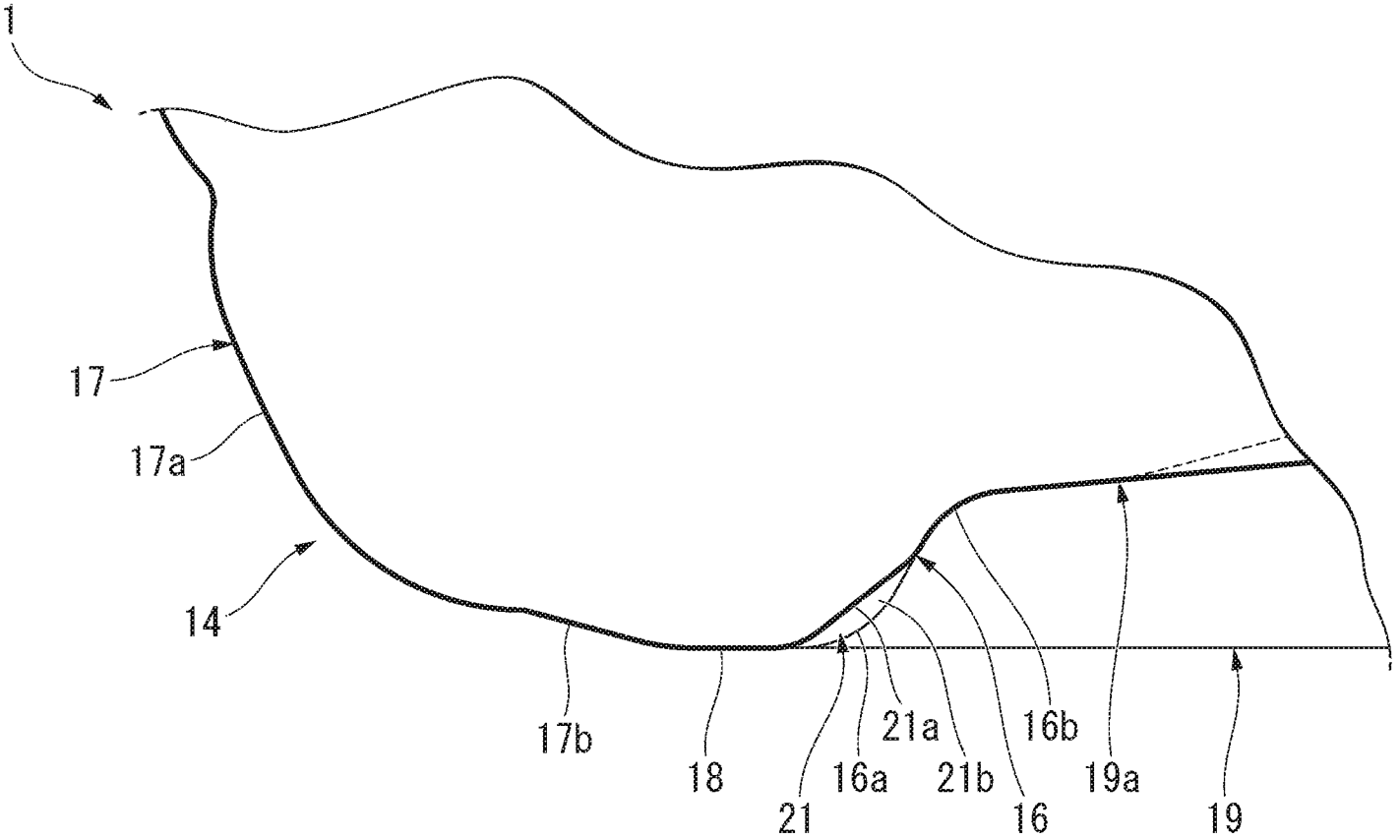
FIG. 3 is a sectional view taken along line III-III of FIG. 2.

As illustrated in FIGS. 1 to 3, a bottle 1 according to the present embodiment includes a mouth portion 11, a shoulder portion 12, a body portion 13, and a bottom portion 14. The bottle 1 has a schematic configuration in which these portions 11 to 14 are consecutively arranged in this order in a state in which the respective central axes are located on the common axis. An internal volume of the bottle 1 is set such that contents of, for example, 200 ml or more and 4000 ml or less are filled. In the illustrated example, the bottle 1 is sized to be filled with 500 ml of contents.

Hereinafter, the aforementioned common axis is referred to as a bottle axis O, the mouth portion 11 side along the direction of the bottle axis O is referred to as an upper side, the bottom portion 14 side along the direction of the bottle axis O is referred to as a lower side, a direction along the bottle axis O is referred to as a vertical direction, a direction intersecting the bottle axis O as seen from the vertical direction is referred to as a radial direction, and a direction revolving around the bottle axis O is referred to as a circumferential direction.

The bottle 1 is formed integrally of a synthetic resin material. The bottle 1 is formed by injection-molding a preform into a cylindrical shape with a bottom and blow-molding the preform. A cap (not illustrated) is attached to the mouth portion 11. Each of the mouth portion 11, the shoulder portion 12, the body portion 13, and the bottom portion 14 has a circular cross-sectional shape orthogonal to the bottle axis O.

On the body portion 13, a plurality of panel portions 13*a* each having a rectangular shape which is long in the vertical direction are formed at intervals in the circumferential direction. An annular groove 15 is formed in a lower end portion of the body portion 13 located below the panel portions 13*a*. The annular groove 15 extends continuously over the entire circumference of the body portion 13. An outer diameter of a portion of the lower end portion of the body portion 13 located below the annular groove 15 gradually decreases as it goes downward.

The bottom portion 14 includes a bottom wall portion 19 with a grounding portion 18 located at an outer circumferential edge thereof, and a tubular heel portion 17 extending upward from an outer circumferential edge of the grounding portion 18.

The heel portion 17 is formed in a curved surface shape protruding outward in the radial direction. An upper end opening edge of the heel portion 17 is connected to a lower end opening edge of the body portion 13. A lower end opening edge of the heel portion 17 is connected to an outer circumferential edge of the bottom wall portion 19, that is, the outer circumferential edge of the grounding portion 18. As illustrated in FIG. 3, the heel portion 17 includes an upper heel portion 17*a* connected to the lower end opening edge of the body portion 13, and a lower heel portion 17*b* connected to the outer circumferential edge of the grounding portion 18. In the vertical sectional view along the vertical direction, the upper heel portion 17*a* is longer than the lower heel portion 17*b*, and the curvature radius of the lower end portion of the upper heel portion 17*a* is smaller than the curvature radius of the lower heel portion 17*b*. In the vertical sectional view, the curvature radius of the heel portion 17 is equal over the entire circumference.

The bottom wall portion 19 includes an inner circumferential wall portion 16 extending upward from the inner circumferential edge of the grounding portion 18, and a recessed wall portion 19*a* extending inward in the radial direction from an upper end of the inner circumferential wall portion 16.

The inner circumferential wall portion 16 gradually extends inward in the radial direction as it goes upward. A lower portion 16*a* of the inner circumferential wall portion 16 is formed in a curved surface shape protruding inward in the radial direction, and an upper portion 16*b* of the inner circumferential wall portion 16 is formed in a curved surface shape recessed toward the outer side in the radial direction. In the vertical sectional view, the respective curvature radii of the lower portion 16*a* and the upper portion 16*b* of the inner circumferential wall portion 16 are equal to each other.

The recessed wall portion 19*a* gradually extends upward from the upper end of the inner circumferential wall portion 16 toward the inner side in the radial direction and is formed in a multistage cylindrical shape. The recessed wall portion 19*a* may extend straight inward in the radial direction from the upper end of the inner circumferential wall portion 16.

In the present embodiment, as illustrated in FIG. 2, a plurality of concave portions 21 are formed on the inner circumferential wall portion 16 over the entire circumference. The concave portion 21 is located at a portion in the inner circumferential wall portion 16 including at least the lower end edge of the inner circumferential wall portion 16. The concave portion 21 is continuously formed on both the grounding portion 18 and the inner circumferential wall portion 16. The concave portion 21 is located below the upper end of the inner circumferential wall portion 16. In the illustrated example, the concave portion 21 is formed over the entire region of the inner circumferential wall portion 16, except the upper portion 16*b*, and the inner circumferential edge portion of the grounding portion 18.

The concave portion 21 is defined by a bottom surface 21*a* facing inward in the radial direction, and a pair of side surfaces 21*b* extending inward in the radial direction from both end portions of the bottom surface 21*a* in the circumferential direction and facing each other in the circumferential direction. The bottom surface 21*a* of the concave portion 21 gradually extends inward in the radial direction as it goes upward. The bottom surface 21*a* of the concave portion 21 extends linearly in the vertical sectional view. The pair of side surfaces 21*b* of the concave portion 21 extend so that the pair of side surfaces 21*b* are gradually separated from each other in the circumferential direction from the bottom surface 21*a* toward the inner side in the radial direction.

As viewed from the radial direction, the concave portion 21 has a rectangular shape in which one pair of sides extends in the circumferential direction and the other pair of sides extends in the vertical direction. The size of the concave portion 21 in the circumferential direction is equal to an interval between the concave portions 21 adjacent to each other in the circumferential direction.

As described above, according to the bottle 1 of the present embodiment, since the plurality of concave portions 21 are formed on the inner circumferential wall portion 16 over the entire circumference, the rigidity of the inner circumferential wall portion 16 is enhanced, and it is possible to suppress the inner circumferential wall portion 16 from deforming at the time of heat filling. In addition, since the concave portion 21 is located at a portion in the inner circumferential wall portion 16 including at least the lower end edge of the inner circumferential wall portion 16, it is possible to make it difficult for the inner circumferential wall portion 16 to deform to collapse inward in the radial direction around the lower end edge thereof, and it is possible to suppress the grounding portion 18 from deforming to protrude downward at the time of heat filling.

In addition, since the plurality of concave portions 21 are formed on the inner circumferential wall portion 16 over the entire circumference, and the concave portion 21 is continuously formed on both the grounding portion 18 and the inner circumferential wall portion 16, it is possible to more reliably suppress the inner circumferential wall portion 16 from deforming to collapse inward in the radial direction around the lower end edge thereof at the time of heat filling.

In addition, since the concave portion 21 rather than a convex portion reaches from the inner circumferential wall portion 16 to the grounding portion 18, it is possible to ensure grounding stability.

In addition, since the concave portion 21 is located below the upper end of the inner circumferential wall portion 16 and is formed in a limited region of the bottom wall portion 19 without reaching the recessed wall portion 19*a* of the bottom wall portion 19, it is possible to suppress an occurrence of variations in the thickness of the bottom wall portion 19 at the time of blow molding and to form the grounding portion 18 with high accuracy.

Next, a second embodiment of the present invention will be described, but the basic configuration is the same as that of the first embodiment. For this reason, similar configurations are denoted by the same reference numerals, their explanation will be omitted, and only different points will be described.

Figure 4:
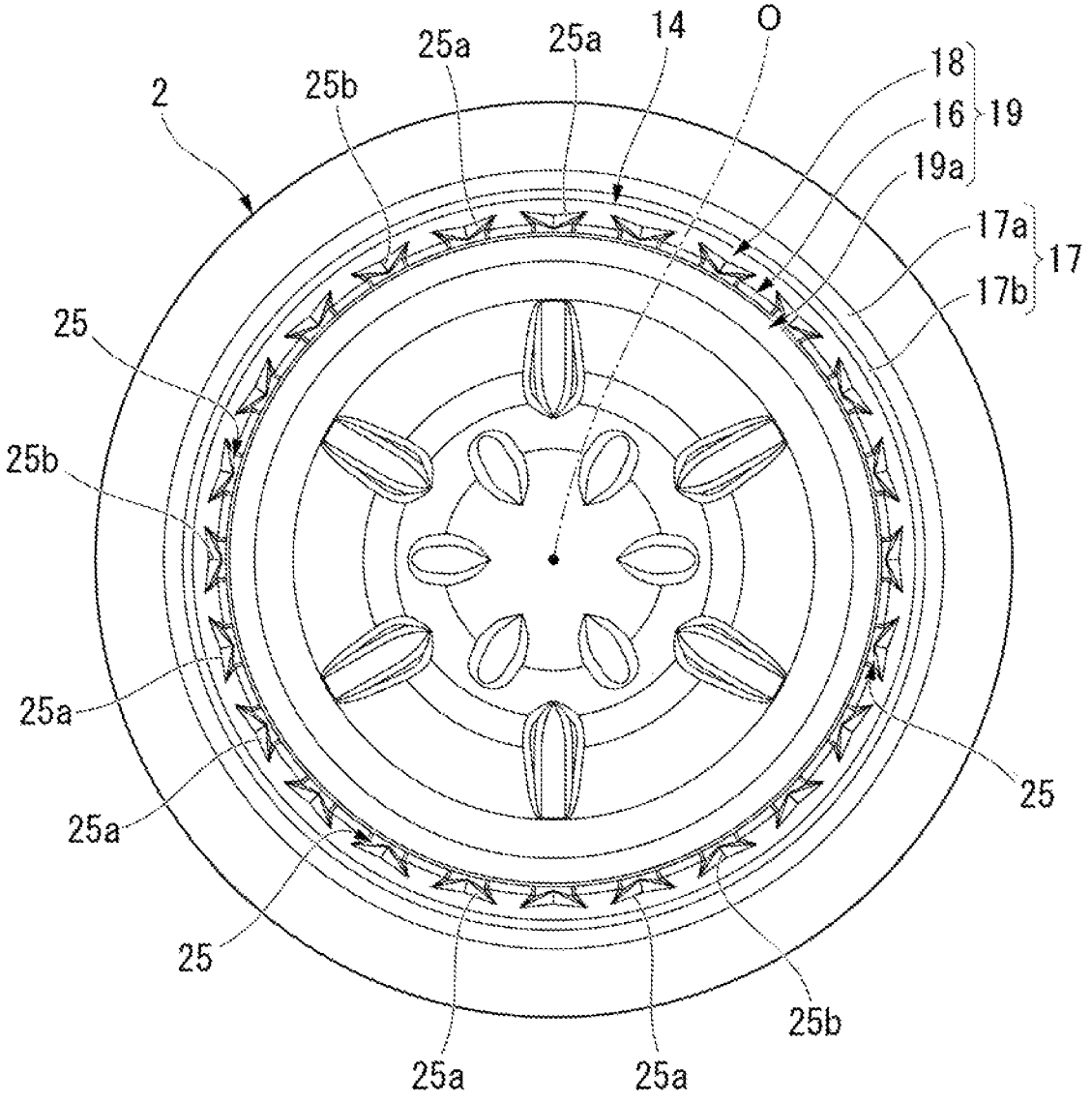
FIG. 4 is a bottom view of a bottle illustrated as a second embodiment according to the present invention.

In a bottle 2 of the present embodiment, as illustrated in FIG. 4, a plurality of concave portions 25, which are formed on the inner circumferential wall portion 16 over the entire circumference thereof, reach a central portion of the grounding portion 18 in the radial direction. A bottom surface of the concave portion 25 is configured such that two inclined surfaces 25*a* are connected to each other via a ridgeline 25*b* along the circumferential direction. The inclined surfaces 25*a* gradually extend inward in the radial direction from both end portions of the concave portion 25 in the circumferential direction toward the central portion.

Both end portions of the concave portion 25 in the circumferential direction gradually extend inward in the circumferential direction from the lower side to the upper side, and the size of the concave portion 25 in the circumferential direction gradually decreases from the lower side to the upper side. As viewed from the radial direction, the concave portion 25 has a triangular shape in which two base angles are located at the lower end and one apex angle is located at the upper end.

As described above, according to the bottle 2 of the present embodiment, since the bottom surface of the concave portion 25 is configured such that the two inclined surfaces 25*a* are connected to each other via the ridgeline 25*b* along the circumferential direction, as the inner circumferential wall portion 16 deforms to collapse inward in the radial direction around the lower end edge thereof at the time of heat filling, it is possible to easily deform the bottom surface of the concave portion 25 in the circumferential direction, and the force generated on the bottom surface of the concave portion 25 can be dispersed in the circumferential direction. As a result, it is possible to suppress the grounding portion 18 from deforming to protrude downward at the time of heat filling.

The technical scope of the present invention is not limited to the embodiments described above, and various modifications can be made without departing from the spirit of the present invention.

For example, in the above-described embodiment, the plurality of concave portions 21 are formed on the inner circumferential wall portion 16 over the entire circumference, but a plurality of convex portions may be formed on the inner circumferential wall portion 16 over the entire circumference.

Further, the synthetic resin material for forming the bottles 1 and 2 may be appropriately changed, for example, to polyethylene terephthalate, polyethylene naphthalate, amorphous polyester, or the like, or blended materials thereof, or the like.

Furthermore, the bottles 1 and 2 are not limited to a single layer structure, and may be a laminated structure having an intermediate layer. As the intermediate layer, for example, a layer made of a resin material having a gas barrier property, a layer made of a recycled material, a layer made of a resin material having oxygen absorbability, and the like can be adopted.

Further, in the above-described embodiment, each of the mouth portion 11, the shoulder portion 12, the body portion 13, and the bottom portion 14 has a circular cross-sectional shape orthogonal to the bottle axis O. However, the present invention is not limited to this, and the shapes thereof may be appropriately changed to, for example, an angular shape or the like.

Besides, it is possible to appropriately replace the constituent elements in the above embodiment with well-known constituent elements, and the above-described modified examples may be combined as appropriate within the scope not deviating from the gist of the present invention.

1, 2 Bottle
14 Bottom portion
16 Inner circumferential wall portion
17 Heel portion
18 Grounding portion
19 Bottom wall
21, 25 Concave portion

What is claimed is:

1. A bottle formed of a synthetic resin material in a bottomed cylindrical shape, the bottle comprising:

a bottom portion which includes a bottom wall portion with a grounding portion located at an outer circumferential edge thereof, and a tubular heel portion extending upward starting at an outer circumferential edge of the grounding portion, the grounding portion being only a lowermost portion of the bottom portion, wherein:

the bottom wall portion includes the grounding portion, an inner circumferential wall portion extending upward starting at an inner circumferential edge of the grounding portion, and a recessed wall portion extending inward in a radial direction from an upper end of the inner circumferential wall portion, a plurality of concave portions is formed on the inner circumferential wall portion over the entire circumference of the inner circumferential wall portion, and the plurality of concave portions is located at a portion in the inner circumferential wall portion including at least a lower end edge of the inner circumferential wall portion, the plurality of concave portions is continuously formed on both the grounding portion and the inner circumferential wall portion, a lower portion of the inner circumferential wall portion is formed in a curved surface shape protruding inward in the radial direction, the lower portion of the inner circumferential wall portion extending upward starting at the inner circumferential edge of the grounding portion, and each of the plurality of concave portions is formed over an inner circumferential edge portion of the grounding portion and the lower portion of the inner circumferential wall portion, each of the plurality of concave portions begins extending inward in the radial direction at the inner circumferential edge portion of the grounding perter-portion, and the plurality of concave portions are located entirely below an upper end of the inner circumferential wall portion.

2. The bottle according to claim 1, wherein each of the plurality of concave portions is defined by a bottom surface facing inward in the radial direction and a pair of side surfaces extending inward in the radial direction from both end portions of the bottom surface in a circumferential direction and facing each other in the circumferential direction, the bottom surface gradually extends inward in the radial direction as it goes upward, and the pair of side surfaces extend such that the pair of side surfaces are gradually separated from each other in the circumferential direction from the bottom surface toward an inner side in the radial direction.

3. The bottle according to claim 1, wherein a bottom surface of each of the plurality of concave portions is configured such that two inclined surfaces are connected to each other in a circumferential direction via a ridgeline, and gradually extends inward in the radial direction from both end portions of the concave portion in the circumferential direction toward a central portion of the concave portion in the circumferential direction, both end portions of the concave portion in the circumferential direction gradually extend inward in the circumferential direction from a lower side to an upper side, and a size of the concave portion in the circumferential direction gradually decreases from the lower side to the upper side.

* * * * *